US011959149B2

(12) United States Patent
Imamura et al.

(10) Patent No.: US 11,959,149 B2
(45) Date of Patent: Apr. 16, 2024

(54) GRAIN-ORIENTED ELECTRICAL STEEL SHEET AND IRON CORE USING SAME

(71) Applicant: JFE STEEL CORPORATION, Tokyo (JP)

(72) Inventors: Takeshi Imamura, Tokyo (JP); Makoto Watanabe, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 500 days.

(21) Appl. No.: 17/426,729

(22) PCT Filed: Jan. 30, 2020

(86) PCT No.: PCT/JP2020/003533
§ 371 (c)(1),
(2) Date: Jul. 29, 2021

(87) PCT Pub. No.: WO2020/158893
PCT Pub. Date: Aug. 6, 2020

(65) Prior Publication Data

US 2022/0098697 A1 Mar. 31, 2022

(30) Foreign Application Priority Data

Jan. 31, 2019 (JP) ..... 2019-016394

(51) Int. Cl.
*C21D 9/46* (2006.01)
*C21D 8/12* (2006.01)
(Continued)

(52) U.S. Cl.
CPC ..... *C21D 9/46* (2013.01); *C21D 8/1222* (2013.01); *C21D 8/1233* (2013.01);
(Continued)

(58) Field of Classification Search
None
See application file for complete search history.

(56) References Cited

U.S. PATENT DOCUMENTS 4,293,350 A 10/1981 Ichiyama et al.
4,595,426 A * 6/1986 Iwayama ..... C22C 38/02 420/117
(Continued)

FOREIGN PATENT DOCUMENTS

CN 1138107 A 12/1996
CN 1188811 A 7/1998
(Continued)

OTHER PUBLICATIONS

Oct. 12, 2022, Office Action issued by the Korean Intellectual Property Office in the corresponding Korean Patent Application No. 10-2021-7023938 with English language concise statement of relevance.
(Continued)

*Primary Examiner* — Brian D Walck
(74) *Attorney, Agent, or Firm* — KENJA IP LAW PC

(57) ABSTRACT

Provided are a grain-oriented electrical steel sheet having excellent iron loss property without using magnetic domain refining treatment and an iron core produced using the same. The steel sheet comprises: a predetermined chemical composition; and a steel microstructure in which: crystal grains are made up of coarse secondary recrystallized grains of 5.0 mm or more, fine grains of more than 2.0 mm and less than 5.0 mm contained at a frequency of 0.2 to 5 grains per $cm^2$, and very fine grains of 2.0 mm or less; for each coarse secondary recrystallized grain extending through the sheet in a thickness direction, an area ratio of a region in which projected surfaces of exposed areas of the coarse secondary recrystallized grain on a front side and a back side of the
(Continued)

sheet coincide with each other to each of the exposed areas is 95% or more.

8 Claims, 3 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/12*** | (2006.01) |
| ***C22C 38/42*** | (2006.01) |
| ***C22C 38/48*** | (2006.01) |
| ***C22C 38/60*** | (2006.01) |

(52) U.S. Cl.
CPC ..... *C21D 8/1255* (2013.01); *C21D 8/1272* (2013.01); *C22C 38/002* (2013.01); *C22C 38/008* (2013.01); *C22C 38/02* (2013.01); *C22C 38/04* (2013.01); *C22C 38/12* (2013.01); *C22C 38/42* (2013.01); *C22C 38/48* (2013.01); *C22C 38/60* (2013.01); *C21D 2201/05* (2013.01)

(56) References Cited

U.S. PATENT DOCUMENTS

| | | | | |
|---|---|---|---|---|
| 4,909,864 | A | 3/1990 | Inokuti et al. | |
| 5,702,541 | A | 12/1997 | Inokuti | |
| 5,800,633 | A | 9/1998 | Inokuti | |
| 5,858,126 | A | 1/1999 | Takashima et al. | |
| 6,309,473 | B1 | 10/2001 | Hayakawa et al. | |
| 6,331,215 | B1 * | 12/2001 | Toge | C22C 38/02 148/113 |
| 6,929,704 | B2 | 8/2005 | Komatsubara et al. | |
| 6,942,740 | B2 | 9/2005 | Hayakawa et al. | |
| 2004/0074565 | A1 * | 4/2004 | Hayakawa | H01F 1/14783 148/111 |
| 2020/0063234 | A1 | 2/2020 | Suehiro et al. | |
| 2022/0098697 | A1 * | 3/2022 | Imamura | C21D 8/1222 |

FOREIGN PATENT DOCUMENTS

| | | | | |
|---|---|---|---|---|
| CN | 102197149 | A | 9/2011 | |
| EP | 588342 | A1 * | 3/1994 | C21D 8/12 |
| EP | 837148 | A2 * | 4/1998 | C21D 8/1294 |
| JP | S4015644 | B | 7/1965 | |
| JP | S5113469 | B2 | 4/1976 | |
| JP | S572252 | B2 | 1/1982 | |
| JP | S6256923 | B2 | 11/1987 | |
| JP | H06100996 | A | 4/1994 | |
| JP | H0672266 | B2 | 9/1994 | |
| JP | H08213225 | A | 8/1996 | |
| JP | H1017931 | A | 1/1998 | |
| JP | H1025553 | A | 1/1998 | |
| JP | 2000119823 | A | 4/2000 | |
| JP | 2000129356 | A | 5/2000 | |
| JP | 2001003145 | A | 1/2001 | |
| JP | 2002212687 | A | 7/2002 | |
| JP | 2002220644 | A | 8/2002 | |
| JP | 4106815 | B2 | 6/2008 | |
| JP | 2012126980 | A | 7/2012 | |
| JP | WO2018207873 | A1 | 11/2019 | |
| KR | 1020120008189 | A | 1/2012 | |

OTHER PUBLICATIONS

Jul. 4, 2022, Office Action issued by the China National Intellectual Property Administration in the corresponding Chinese Patent Application No. 202080011581.2 with English language search report.

Apr. 14, 2020, International Search Report issued in the International Patent Application No. PCT/JP2020/003533.

* cited by examiner $$\text{Area ratio of region in which projected surfaces coincide with each other} = \frac{\left(\text{Area of region in which projected surfaces coincide with each other}\right)}{\left(\text{Average of areas of secondary recrystallized grain exposed on front and back sides}\right)} \times 100$$

GRAIN-ORIENTED ELECTRICAL STEEL SHEET AND IRON CORE USING SAME

TECHNICAL FIELD

The present disclosure relates to a grain-oriented electrical steel sheet suitable as an iron core material of a transformer.

BACKGROUND

A grain-oriented electrical steel sheet is a soft magnetic material used as an iron core material of a transformer, and has crystal texture in which the <001> orientation which is the easy magnetization axis of iron is highly aligned with the rolling direction of the steel sheet. Such texture is formed through a phenomenon called secondary recrystallization of preferentially causing the growth of giant crystal grains in the {110}<001> orientation which is called Goss orientation, when purification annealing is performed in the process of producing the grain-oriented electrical steel sheet.

A typical technique used for such texture formation causes grains having Goss orientation to undergo secondary recrystallization during purification annealing using a precipitate called an inhibitor. For example, JP S40-15644 B2 (PTL 1) discloses a method using MN and MnS, and JP S51-13469 B2 (PTL 2) discloses a method using MnS and MnSe. These methods are in actual use industrially.

These methods using inhibitors are useful in stably developing secondary recrystallized grains. For fine particle distribution of the inhibitor into the steel, however, the slab needs to be heated at a high temperature of 1300° C. or more to dissolve the inhibitor component.

JP 2000-129356 A (PTL 3), for example, discloses a technique of developing Goss-oriented crystal grains by secondary recrystallization using a raw material not containing an inhibitor component. This technique eliminates impurities such as an inhibitor component as much as possible and elicits the dependency of grain boundary energy of crystal grain boundaries in primary recrystallization on the grain boundary misorientation angle, thus causing secondary recrystallization of Goss-oriented grains without using an inhibitor. This effect is called a texture inhibition effect. This method does not require fine particle distribution of an inhibitor into steel, and therefore does not need to perform high-temperature slab heating which used to be considered essential. Thus, the method is highly advantageous in terms of both cost and maintenance.

As mentioned above, a grain-oriented electrical steel sheet is mainly used as an iron core of a transformer, and accordingly is required to have excellent magnetization properties, in particular low iron loss.

Hence, it is important to highly align secondary recrystallized grains in the steel sheet with {110}<001> orientation (i.e. Goss orientation) and reduce impurities in the product steel sheet. Further, a magnetic domain refining technique is developed. The magnetic domain refining technique is a technique of introducing non-uniformity to the steel sheet surface by a physical method and refining the magnetic domain width to reduce iron loss.

For example, JP S57-2252 B2 (PTL 4) proposes a technique of irradiating a steel sheet after final annealing with a laser to introduce a high dislocation density region into the surface layer of the steel sheet and narrow the magnetic domain width to reduce the iron loss of the steel sheet.

JP H6-72266 B2 (PTL 5) proposes a technique of controlling the magnetic domain width by irradiation with an electron beam.

CITATION LIST

Patent Literatures

PTL 1: JP S40-15644 B2
PTL 2: JP S51-13469 B2
PTL 3: JP 2000-129356 A
PTL 4: JP S57-2252 B2
PTL 5: JP H6-72266 B2
PTL 6: JP S62-56923 B2
PTL 7: JP H10-17931 A
PTL 8: JP 4106815 B2

SUMMARY

Technical Problem

The magnetic domain refining technique has very high iron loss reduction effect, and is often used for top-grade grain-oriented electrical steel sheets with low iron loss. However, the device introduction costs and the running costs are higher than in the grain-oriented electrical steel sheet production processes not using the magnetic domain refining technique. Hence, an iron loss reduction method not using such technique is needed in terms of cost reduction.

Solution to Problem

It could therefore be helpful to propose a grain-oriented electrical steel sheet that can achieve iron loss reduction without using the magnetic domain refining technique.

We conducted intensive study to achieve the objected stated above, and discovered that, by causing fine crystal grains to form in a certain proportion in a steel sheet after final annealing, a grain-oriented electrical steel sheet having excellent iron loss property can be obtained without magnetic domain refining treatment.

Experimental results that led to the discovery of the presently disclosed technique will be described in detail below.

Experiment 1

A steel slab A containing, in mass %, C: 0.030%, Si: 3.33%, Mn: 0.15%, Al: 0.0026%, N: 0.0025%, S: 0.0014%, and Sb: 0.08% with the balance being Fe and inevitable impurities and a steel slab B containing, in mass %, C: 0.031%, Si: 3.27%, Mn: 0.15%, Al: 0.0020%, N: 0.0021%, and S: 0.0013% and not containing Sb with the balance being Fe and inevitable impurities were each produced by continuous casting, subjected to slab heating of soaking at 1200° C. for 30 min, and then hot rolled to a thickness of 2.2 mm. The resultant hot-rolled steel sheet was subjected to hot-rolled sheet annealing at 1080° C. for 30 sec in a dry nitrogen atmosphere, and then cold rolled to a thickness of 0.23 mm. The resultant cold-rolled steel sheet was heated to 700° C. at each of various heating rates from 20° C./s to 1500° C./s in a dry nitrogen atmosphere, and immediately cooled to room temperature at 100° C./s on average without soaking. Following this, the steel sheet was subjected to primary recrystallization annealing also serving as decarburization annealing at 850° C. for 150 sec in a wet atmosphere of 50% $H_2$-50% $N_2$ and a dew point of 50° C.

Further, an annealing separator mainly composed of MgO was applied to the steel sheet, and the steel sheet was subjected to secondary recrystallization annealing also serving as purification annealing of retaining at 1250° C. for 10 hr in a hydrogen atmosphere.

The iron loss $W_{17/50}$ (iron loss when excited to 1.7 T at 50 Hz) of a sample cut out of each resultant product steel sheet was measured by the method described in JIS C 2550-1: 2011. Moreover, the sample was immersed in a 10% hydrochloric acid aqueous solution of 80° C. for 180 sec, and the films on the front and back sides were removed so that secondary recrystallized grains would be recognizable. The grain size distribution of the secondary recrystallized grains was then determined by image analysis. The area of the sample studied to determine the grain size distribution was 336 $cm^2$ (equivalent to four Epstein samples).

FIG. 1 illustrates the result of studying the relationship between the iron loss and the number of crystal grains of more than 2.0 mm and less than 5.0 mm in grain size (per $cm^2$) based on the obtained data.

The following two points are clear from FIG. 1.

First, in the steel slab A containing Sb, the iron loss property was good when the number of crystal grains of more than 2.0 mm and less than 5.0 mm in grain size was 0.2 to 5 per $cm^2$.

Second, in the steel slab B not containing Sb, the number of crystal grains of more than 2.0 mm and less than 5.0 mm in grain size was very small, specifically, less than 0.2 per $cm^2$, and iron loss reduction could not be expected.

In Experiment 1, the steel substrate composition of the product steel sheet resulting from the slab A contained, in mass %, Si: 3.33%, Mn: 0.15%, and Sb: 0.08%, with the balance being Fe and inevitable impurities. The steel substrate composition of the product steel sheet resulting from the slab B contained, in mass %, Si: 3.27% and Mn: 0.15%, with the balance being Fe and inevitable impurities. That is, in each product steel sheet, while C, Al, N, and S were substantially not present as a result of decarburization and purification, the contents of the other components were the same as those in the corresponding slab.

Furthermore, close study on the crystal orientations of crystal grains of more than 2.0 mm and less than 5.0 mm in grain size (hereafter also referred to as "fine grains") in each product steel sheet obtained in Experiment 1 by electron backscatter diffraction (EBSD) revealed that the crystal orientations were considerably different from Goss orientation which is the main orientation of coarse secondary recrystallized grains of 5.0 mm or more in grain size. In this experiment, the misorientation angles between the orientations of the fine grains and the Goss orientation were about 25° on average.

Although the mechanism by which good iron loss property is obtained when the composition of the product steel sheet contains Sb and the number of fine grains of more than 2.0 mm and less than 5.0 mm in grain size is 0.2 to 5 per $cm^2$ is not clear, we consider the mechanism as follows:

The degree of iron loss of a grain-oriented electrical steel sheet is significantly influenced by the magnetic domain structure in secondary recrystallized grains. Most of the secondary recrystallized grains in the grain-oriented electrical steel sheet are made up of 180° magnetic domains, i.e. magnetic domains approximately parallel to the rolling direction. The width of each of such magnetic domains significantly influences the iron loss property. In detail, a narrower width contributes to lower iron loss. For example, there is a magnetic domain refining treatment method of providing mechanical linear grooves in a steel sheet. This method utilizes the following magnetic property: when the formation of grooves causes an increase in magnetostatic energy at the groove sections, magnetic domain widths will be narrowed to cancel such increase in energy.

Since there are large misorientation angles between the fine grains and the coarse secondary recrystallized grains as mentioned above, magnetic domains may be discontinuous at the grain boundaries between the fine grains and the coarse secondary recrystallized grains. In this case, there is a possibility that magnetic poles form and magnetostatic energy increases, and it is expected that magnetic domains are refined for the same reason as above. We consider this is the mechanism for iron loss reduction by the fine grains.

According to this mechanism, there is a possibility that the iron loss reduction effect is also ascribed to the large misorientation angles between the fine grains and the coarse secondary recrystallized grains. In detail, the iron loss reduction effect is likely to be higher when the average misorientation angle exceeds more the low-angle range (misorientation angle of less than 15°) in which the misorientation is determined to be small. Therefore, the average misorientation angle between the crystal orientations of the fine grains of more than 2.0 mm and less than 5.0 mm in grain size and the Goss orientation is preferably 15° or more, more preferably 20° or more, and further preferably 25° or more.

Regarding why many fine grains of more than 2.0 mm and less than 5.0 mm in grain size formed in the steel slab A and almost no fine grains of more than 2.0 mm and less than 5.0 mm in grain size formed in the steel slab B, we consider the reason as follows:

Sb contained in the steel slab A is known as a segregation element. As a result of Sb segregating to the grain boundaries of the primary recrystallized grains in the initial stage of the secondary recrystallization and suppressing grain boundary migration, the primary recrystallized grains were prevented from growing to secondary recrystallized grains and consequently the fine grains formed. In the steel slab B, on the other hand, a segregation element such as Sb was not contained in the steel, so that grain boundary migration was not suppressed in the initial stage of the secondary recrystallization and consequently only the coarse secondary recrystallized grains formed without the fine grains.

Examples of iron loss reduction techniques using very fine grains include the methods disclosed in JP S62-56923 B2 (PTL 6) and JP H10-17931 A (PTL 7). However, these documents merely state that very fine grains of 2 mm and less in grain size have magnetic domain refining effect and disclose methods of controlling the very fine grains, and have no mention of fine grains of more than 2 mm in grain size.

This implies that the iron loss reduction techniques disclosed in these documents and the presently disclosed technique substantially differ in technical idea and also differ in the grain size of crystal grains used and the method of controlling the crystal grains.

In Experiment 1, the step of heating the steel sheet to 700° C. in a dry nitrogen atmosphere at an experimentally varied heating rate and, without soaking, immediately cooling the steel sheet to room temperature at 100° C./s on average was added after the cold rolling and before the decarburization annealing, unlike typical grain-oriented electrical steel sheet production methods. We consider that this step contributed to the formation of the fine grains in the secondary recrystallization.

Experiment 2

The steel slab A used in Experiment 1 was subjected to slab heating of soaking at 1200° C. for 60 min, and then hot rolled to a thickness of 2.4 mm. The resultant hot-rolled steel sheet was subjected to hot-rolled sheet annealing at 1000° C. for 30 sec in a dry nitrogen atmosphere, and then cold rolled to a thickness of 0.23 mm. The resultant cold-rolled steel sheet was heated to 700° C. at a heating rate of 750° C./s in a dry nitrogen atmosphere, and immediately cooled to room temperature at 70° C./s on average without soaking. Following this, the steel sheet was subjected to primary recrystallization annealing also serving as decarburization at 850° C. for 120 sec in a wet atmosphere of 55% $H_2$-45% $N_2$ and a dew point of 55° C. Further, an annealing separator mainly composed of MgO was applied to the steel sheet, and the steel sheet was subjected to secondary recrystallization annealing also serving as purification of retaining at each of various temperatures from 1100° C. to 1300° C. in a hydrogen atmosphere. The heating rate to the retention temperature was 20° C./h on average.

The iron loss $W_{17/50}$ (iron loss when excited to 1.7 T at 50 Hz) of a sample cut out of each resultant product steel sheet was measured by the method described in HS C 2550-1: 2011. Moreover, the sample was immersed in a 10% hydrochloric acid aqueous solution of 80° C. for 180 sec, and the films on the front and back sides were removed to expose secondary recrystallized grains. In each sample different in the retention temperature of the secondary recrystallization annealing, for each coarse secondary recrystallized grain extending through the steel sheet in the thickness direction among coarse secondary recrystallized grains of 5 mm or more in grain size, the area ratio of the region in which the projected surfaces of the exposed areas of the coarse secondary recrystallized grain on the front and back sides of the steel sheet coincide with each other to each of the exposed areas was calculated.

A method of calculating the area ratio will be described in detail below, with reference to a schematic diagram in FIG. 2.

The thickness of a grain-oriented electrical steel sheet as a product steel sheet is typically about 0.2 mm to 0.5 mm, and each grain having a larger grain size than the thickness of the steel sheet is basically regarded as extending (i.e. passing) through the steel sheet in the thickness direction. That is, in a grain-oriented electrical steel sheet according to the present disclosure, every coarse secondary recrystallized grain of 5 mm or more in grain size that can be observed on both the front and back sides of the steel sheet from which the films have been removed can be regarded as a grain extending through the steel sheet in the thickness direction.

The area of one coarse secondary recrystallized grain exposed on the front side of the steel sheet is the area two-dimensionally (i.e. planarly) occupied by the secondary recrystallized grain on the steel sheet as a result of being exposed on the front side of the steel sheet in the case where the secondary recrystallized grain is observed on the front side of the steel sheet. More specifically, the area of the secondary recrystallized grain exposed on the front side of the steel sheet is the area of the part enclosed by the grain boundary observed on the front side of the steel sheet. In FIG. 2, the area or its projected surface (i.e. an orthogonal projection of the area) is indicated as a solid-line figure.

The area of the secondary recrystallized grain exposed on the back side of the steel sheet is the area of the part enclosed by the grain boundary in the case where the secondary recrystallized grain is observed on the back side of the steel sheet in the same way as the front side. In FIG. 2, the area or its projected surface (i.e. an orthogonal projection of the area) is indicated as a dashed-line figure.

The region in which the projected surfaces coincide with each other is the part in which, in the case where the area of the secondary recrystallized grain exposed on the front side of the steel sheet and the area of the secondary recrystallized grain exposed on the back side of the steel sheet are projected on one plane parallel to the sheet surface (rolling surface) each as an orthogonal projection, the orthogonal projections overlap (i.e. coincide). In FIG. 2, the region is indicated as a shaded part.

Hence, the "area ratio of the region in which the projected surfaces of the exposed areas of the coarse secondary recrystallized grain on the front and back sides of the steel sheet coincide with each other to each of the exposed areas" is the area ratio at which the exposed area of the secondary crystal grain on the front side of the steel sheet and the exposed area of the same secondary crystal grain on the back side of the steel sheet overlap in the direction perpendicular to the rolling direction (i.e. the thickness direction) of the steel sheet. The area ratio is calculated according to the formula illustrated in FIG. 2. When the area ratio is closer to 100%, the grain boundary of the secondary recrystallized grain is closer to being perpendicular to the steel sheet rolling surface.

The area ratio was higher when the secondary recrystallization annealing temperature was higher. The total area of the sample studied to yield the area ratio was 336 $cm^2$ (equivalent to four Epstein samples). FIG. 3 illustrates the result of studying the relationship between the area ratio and the iron loss.

As is clear from FIG. 3, when the area ratio was higher, the iron loss was lower, i.e. the iron loss property was better.

Although the mechanism by which the iron loss property is better when, for each coarse secondary recrystallized grain extending through the steel sheet as a product steel sheet in the thickness direction, the area ratio of the region in which the projected surfaces of the respective areas of the coarse secondary recrystallized grain exposed on the front and back sides of the steel sheet coincide with each other to each of the areas of the coarse secondary recrystallized grain exposed is higher is not clear, we consider the mechanism as follows:

JP 4106815 B2 (PTL 8) describes the blanking workability of a grain-oriented electrical steel sheet as a product steel sheet, and points out that, as a result of bringing the secondary recrystallized grain boundary closer to being perpendicular to the sheet surface, the possibility of shearing the grain boundary can be reduced and the blanking workability can be improved. In PTL 8, the retention time in the secondary recrystallization annealing is increased to cause the grain boundary to be perpendicular. The same phenomenon is expected to occur by increasing the retention temperature in the secondary recrystallization annealing as in Experiment 2. In detail, it is presumed that, as a result of increasing the retention temperature, the grain boundary becomes perpendicular to the sheet surface (rolling surface), and consequently the area ratio increases and the iron loss is improved. According to this presumption, the iron loss is lower when the grain boundary is closer to being perpendicular. Although the reason for this is not clear, we consider the reason as follows: When the grain boundary is closer to being perpendicular, the magnetic domains in the grain are less disturbed, and the displacement of the magnetic domain wall when the steel sheet is excited is smoother, so that the iron loss is reduced.

In Experiment 2, good iron loss property was obtained when the area ratio was 95% or more. An effective way of achieving such an area ratio is to set the retention temperature in the secondary recrystallization annealing to a very high temperature of 1260° C. or more.

Thus, in the present disclosure, at least a certain number of fine grains of more than 2.0 mm and less than 5.0 mm in grain size need to be formed for iron loss reduction. The formation of the fine grains is a technique first realized only by employing non-conventional methods that involve using at least one segregation element and optionally involve, for example, adding a step of heating to 700° C. at a high heating rate and immediately rapid cooling without soaking after cold rolling and before decarburization annealing and/or performing secondary recrystallization annealing at a very high annealing temperature.

The presently disclosed technique is, however, not limited to such means of forming the fine grains, as long as the fine grains are formed in the steel microstructure of the product steel sheet. For example, there are cases where, when the segregation element is contained in a large amount, the fine grains increase in number and a product steel sheet within the range according to the present disclosure is obtained without the step of heating to 700° C. at a high heating rate and immediately rapid cooling without soaking after cold rolling and before decarburization annealing.

Since the presently disclosed technique is intended to reduce the cost increase caused by magnetic domain refining treatment, the product steel sheet is not magnetic domain refining treated.

The present disclosure is based on these discoveries.

We thus provide:

1. A grain-oriented electrical steel sheet comprising: a chemical composition containing (consisting of), in mass %, Si: 1.5% to 8.0%, Mn: 0.02% to 1.0%, and at least one selected from Sn: 0.010% to 0.400%, Sb: 0.010% to 0.400%, Mo: 0.010% to 0.200%, and P: 0.010% to 0.200%, with a balance being Fe and inevitable impurities; and a microstructure in which: crystal grains are made up of coarse secondary recrystallized grains of 5.0 mm or more in grain size, fine grains of more than 2.0 mm and less than 5.0 mm in grain size, and very fine grains of 2.0 mm or less in grain size; for each coarse secondary recrystallized grain extending through the steel sheet in a thickness direction from among the coarse secondary recrystallized grains, an area ratio of a region in which projected surfaces of respective areas of the coarse secondary recrystallized grain exposed on a front side and a back side of the steel sheet coincide with each other to each of the areas of the coarse secondary recrystallized grain exposed is 95% or more; and the fine grains of more than 2.0 mm and less than 5.0 mm in grain size are contained at a frequency of 0.2 grains to 5 grains per $cm^2$, wherein the steel sheet is not magnetic domain refining treated.

2. The grain-oriented electrical steel sheet according to 1., wherein an average of misorientation angles between crystal orientations of the fine grains of more than 2.0 mm and less than 5.0 mm in grain size and Goss orientation is 15° or more.

3. The grain-oriented electrical steel sheet according to 1. or 2., wherein the chemical composition further contains, in mass %, one or more selected from Cr: 0.01% to 0.50%, Cu: 0.01% to 0.50%, Ni: 0.01% to 0.50%, Bi: 0.005% to 0.50%, and Nb: 0.001% to 0.01%.

4. A coil iron core produced using the grain-oriented electrical steel sheet according to any of 1. to 3.

Advantageous Effect

It is thus possible to obtain a grain-oriented electrical steel sheet having excellent iron loss property without using magnetic domain refining treatment, by causing fine crystal grains with a specific grain size to form in a certain proportion in a steel sheet after final annealing.

It is also possible to achieve both high-frequency iron loss reduction and blanking workability improvement, by containing at least one segregation element and optimizing the heating rate and the retention time in secondary recrystallization annealing.

DETAILED DESCRIPTION

Figure 1:
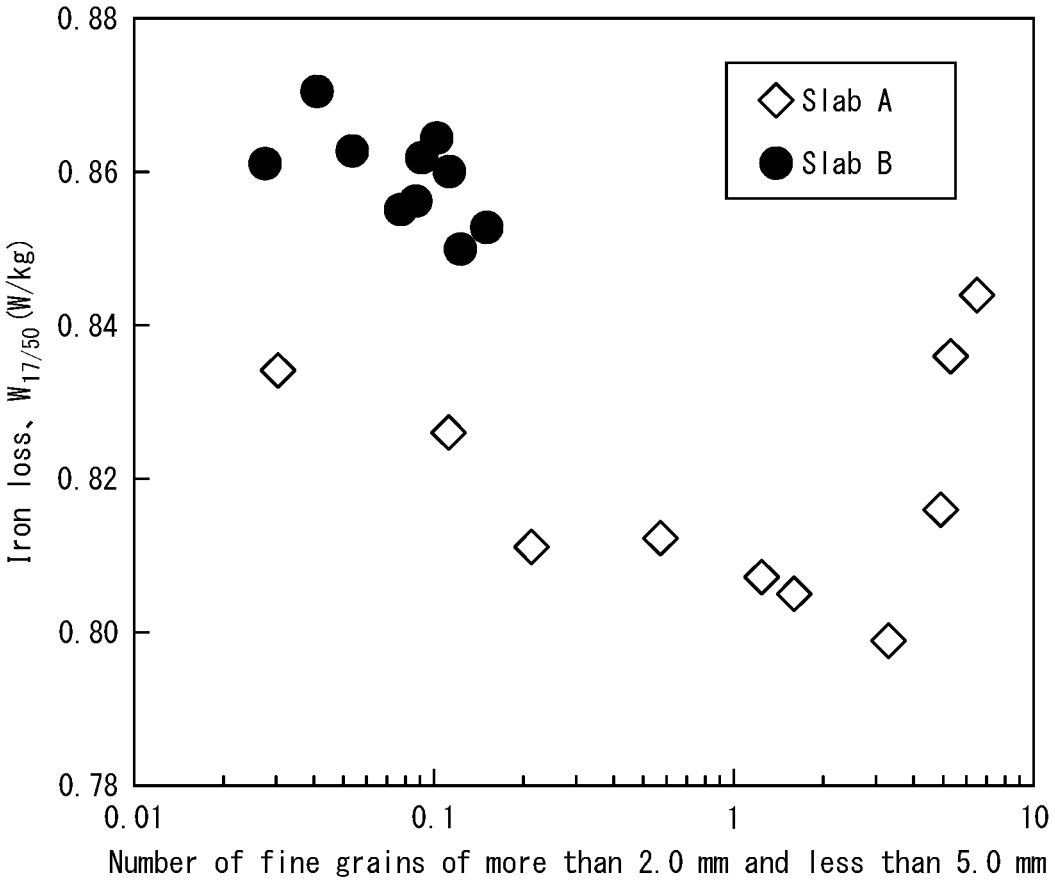
FIG. 1 is a diagram illustrating the relationship between the number of fine grains in each product steel sheet and the iron loss of the product steel sheet.

The presently disclosed technique will be described in detail below. The reasons for limiting the chemical composition to the foregoing range in the present disclosure will be described first. Hereafter, "%" and "ppm" with regard to the composition denote "mass %" and "mass ppm", respectively. Si: 1.5% to 8.0%

Si is a necessary element to enhance the specific resistance of the steel and improve the iron loss. If the Si content is less than 1.5%, the effect of adding Si is insufficient. If the Si content is more than 8.0%, the workability of the steel degrades, which hinders rolling. The Si content is therefore limited to 1.5% to 8.0%. The Si content is preferably 2.5% to 4.5%.

Mn: 0.02% to 1.0%

Mn is a necessary element to improve the hot workability. If the Mn content is less than 0.02%, the effect is insufficient. If the Mn content is more than 1.0%, the magnetic flux density of the product steel sheet decreases. The Mn content is therefore limited to 0.02% to 1.0%. The Mn content is preferably 0.04% to 0.20%.

To cause fine grains for suppressing grain boundary migration to be present in a certain proportion in the steel sheet as mentioned above, at least one selected from Sn: 0.010% to 0.400%, Sb: 0.010% to 0.400%, Mo: 0.010% to 0.200%, and P: 0.010% to 0.200% as segregation elements needs to be contained. For each element, if the content is less than the lower limit, the frequency of the fine grains decreases, and the iron loss reduction effect cannot be achieved. If the content is more than the upper limit, the steel embrittles, and the risk of impairing the productivity, such as occurrence of a fracture during production, increases. Preferable ranges are Sn: 0.020% to 0.100%, Sb: 0.020% to 0.100%, Mo: 0.020% to 0.070%, and P: 0.012% to 0.100%.

While the basic components according to the present disclosure have been described above, the chemical composition according to the present disclosure may optionally further contain the following elements.

One or more selected from Cr: 0.01% to 0.50%, Cu: 0.01% to 0.50%, Ni: 0.01% to 0.50%, Bi: 0.005% to 0.50%, and Nb: 0.001% to 0.01% may be added in order to improve the magnetic properties. For each element, if the content is less than the lower limit, the magnetic property improving effect cannot be achieved. If the content is more than the upper limit, the development of secondary recrystallized grains is inhibited and the magnetic properties degrade.

The balance other than the elements described above consists of Fe and inevitable impurities. Examples of the inevitable impurities include C, Al, N, S, and Se which are considerably reduced as a result of purification or decarburization. Their inevitable impurity levels are not limited, but preferably C is less than 30 ppm, N is less than 20 ppm, and Al, S, and Se are each less than 10 ppm.

For the reasons stated above, it is essential that: the crystal grains in the product steel sheet are made up of coarse secondary recrystallized grains of 5.0 mm or more in grain size, fine grains of more than 2.0 mm and less than 5.0 mm in grain size, and very fine grains of 2.0 mm or less in grain size; for each coarse secondary recrystallized grain extending through the steel sheet in the thickness direction from among the coarse secondary recrystallized grains, the area ratio of the region in which the projected surfaces of the respective areas of the coarse secondary recrystallized grain exposed on the front and back sides of the steel sheet coincide with each other to each of the areas of the coarse secondary recrystallized grain exposed is 95% or more; and the fine grains of more than 2.0 mm and less than 5.0 mm in grain size are contained at a frequency of 0.2 grains to 5 grains per $cm^2$. In the calculation of the grain size of each crystal grain, the grain boundary is extracted through image analysis and elliptically approximated by an elliptical approximation method, and the average of the major axis length and the minor axis length is taken to be the grain size of the crystal grain.

A method of producing the grain-oriented electrical steel sheet according to the present disclosure will be described below.

As the method of producing the grain-oriented electrical steel sheet according to the present disclosure, a typical electrical steel sheet production method may be used. In detail, a molten steel adjusted to a predetermined composition may be subjected to typical ingot casting or continuous casting to produce a slab, or subjected to direct casting to produce a thin slab or thinner cast steel of 100 mm or less in thickness. The foregoing preferred components (Si, Mn, segregation elements, optional component elements) are preferably added in the molten steel stage as it is difficult to add them in an intermediate step. The contents of Si, Mn, segregation elements, and optional component elements in the slab produced in this way are maintained in the chemical composition of the product steel sheet.

The contents of the inevitable impurities such as C, Al, N, S, and Se in the slab are not limited. To achieve the foregoing inevitable impurity levels in the product steel sheet, for example, the contents of the inevitable impurities are preferably C: 0.10% or less, Al: 500 ppm or less, N: 100 ppm or less, and each of S and Se: 200 ppm or less.

Before hot rolling, the slab is heated by a usual method. For a slab having a chemical composition with low content of an inhibitor component, high-temperature annealing for dissolving the inhibitor is unnecessary. Accordingly, the slab heating temperature is preferably a low temperature of less than 1300° C. from the viewpoint of cost reduction. The slab heating temperature is more preferably 1250° C. or less. For a slab having a chemical composition with high content of an inhibitor component, the slab heating temperature is preferably 1300° C. or more in order to dissolve the inhibitor.

The steel slab heated to the slab heating temperature is then hot rolled to obtain a hot-rolled steel sheet. The hot rolling conditions are not limited, and may be any conditions.

The hot-rolled steel sheet is then optionally subjected to hot-rolled sheet annealing. The hot-rolled sheet annealing temperature is preferably about 950° C. to 1150° C. It the hot-rolled sheet annealing temperature is lower than this range, non-recrystallized parts remain. It the hot-rolled sheet annealing temperature is higher than this range, the grain size after the annealing is excessively coarse, causing the subsequent primary recrystallized microstructure to be inappropriate. The hot-rolled sheet annealing temperature is preferably 1000° C. or more. The hot-rolled sheet annealing temperature is preferably 1100° C. or less.

The steel sheet after the hot rolling or the hot-rolled sheet annealing is subjected to cold rolling once or subjected to cold rolling twice or more with intermediate annealing therebetween, to obtain a cold-rolled sheet with a final thickness. The annealing temperature in the intermediate annealing is preferably in a range of 900° C. to 1200° C. If the annealing temperature is less than 900° C., the recrystallized grains after the intermediate annealing become fine, and also the Goss-oriented nuclei in the primary recrystallized microstructure decrease and the magnetic properties of the product steel sheet decrease. If the annealing temperature is more than 1200° C., the crystal grains coarsen excessively as in the hot-rolled sheet annealing, making it difficult to obtain primary recrystallized microstructure of uniformly-sized grains.

The cold-rolled sheet with the final thickness is then subjected to decarburization annealing and primary recrystallization annealing. In the case where the primary recrystallization annealing also serves as the decarburization annealing, the annealing temperature is preferably in a range of 800° C. to 900° C. and the annealing atmosphere is preferably a wet atmosphere, from the viewpoint of facilitating decarburization reaction. The primary recrystallization annealing and the decarburization annealing may be performed separately.

In Experiments 1 and 2 described above, the foregoing product steel sheet is obtained by a method whereby the steel sheet is heated to 700° C. at a high heating rate and then, without soaking, immediately rapid-cooled after cold rolling and before decarburization annealing, and subsequently reheated and subjected to decarburization annealing. In the present disclosure, such a step of heating to 700° C. at a high heating rate and immediately cooling to around room temperature at a high cooling rate without soaking is preferably performed before the decarburization annealing. This is intended to form at least a certain number of fine grains of more than 2.0 mm and less than 5.0 mm in grain size and thus effectively reduce the iron loss of the product steel sheet. From the viewpoint of ensuring the formation of the fine grains, the heating rate in the step is preferably in a range of 100° C./s to 3000° C./s, and the cooling rate in the step is preferably in a range of 5° C./s to 200° C./s.

After applying an annealing separator mainly composed of MgO to the steel sheet that has undergone the decarburization annealing and the primary recrystallization annealing, the steel sheet is subjected to secondary recrystallization annealing also serving as purification annealing. This enables secondary recrystallized microstructure to develop and a forsterite film to form. To develop secondary recrystallization, the secondary recrystallization annealing is preferably performed at 800° C. or more. Moreover, in the present disclosure, the retention temperature is preferably 1250° C. or more, to make the grain boundary of each coarse secondary recrystallized grain perpendicular to the sheet surface and, for each coarse secondary recrystallized grain extending through the steel sheet in the thickness direction, set the area ratio of the region in which the projected surfaces of the exposed areas of the coarse secondary recrystallized grain on the front and back sides of the steel sheet coincide with each other to each of the exposed areas to a high area ratio of 95% or more. The retention temperature is more preferably 1260° C. or more. In the present disclosure, the production method is not limited, but it is preferable to perform secondary recrystallization annealing also serving as purification annealing at a higher retention temperature than usual.

It is effective to perform, after the purification annealing, water washing, brushing, pickling, or the like to remove the unreacted annealing separator adhering to the front and back sides of the steel sheet. By subsequently performing flattening annealing for shape adjustment, the iron loss can be reduced effectively.

In the case of using the steel sheet in a stacked state, it is effective to form an insulation coating on the front and back sides of the steel sheet before or after the flattening annealing, in order to improve the iron loss. A coating capable of imparting tension to the steel sheet is preferable for iron loss reduction. A coating method of applying a tension coating through a binder or a coating method of depositing an inorganic substance onto the steel sheet surface layer by physical vapor deposition or chemical vapor deposition is preferably used as it provides excellent coating adhesion and has a considerable iron loss reduction effect.

The grain-oriented electrical steel sheet according to the present disclosure can be suitably obtained by the above-described production method. The production method for the grain-oriented electrical steel sheet is, however, not limited to such, as long as the grain-oriented electrical steel sheet has the features defined in the present disclosure.

The grain-oriented electrical steel sheet according to the present disclosure is not magnetic domain refining treated. Herein, "the steel sheet is not magnetic domain refining treated" means that the steel sheet is produced without treatment of introducing non-uniformity (stress) to the steel sheet surface by a physical method and refining the magnetic domain width. Non-limiting examples of such treatment include heat resistant stress introduction such as linear or spot groove formation and non-heat resistant stress introduction by irradiation with a laser beam, an electron beam, a plasma flame, ultraviolet light, or the like.

Since the grain-oriented electrical steel sheet according to the present disclosure is not magnetic domain refining treated, removal of non-heat resistant stress by stress relief annealing in coil iron core production and a decrease in magnetic flux density caused by heat resistant magnetic domain refining can be prevented. Such a grain-oriented electrical steel sheet is useful as a material of a coil iron core produced through stress relief annealing.

EXAMPLES

In Examples 1 and 2, grain-oriented electrical steel sheets according to examples and comparative examples were produced and their property values were studied by the following measurement methods.

The measurement methods will be described in detail below.

[Area Ratio of Region in which Projected Surfaces Coincide with Each Other]

A sample of 336 $cm^2$ in total area (equivalent to four Epstein samples) cut out of a product steel sheet was immersed in a 10% hydrochloric acid aqueous solution of 80° C. for 180 sec, and the films on the front and back sides were removed to expose secondary recrystallized grains.

Figure 2:
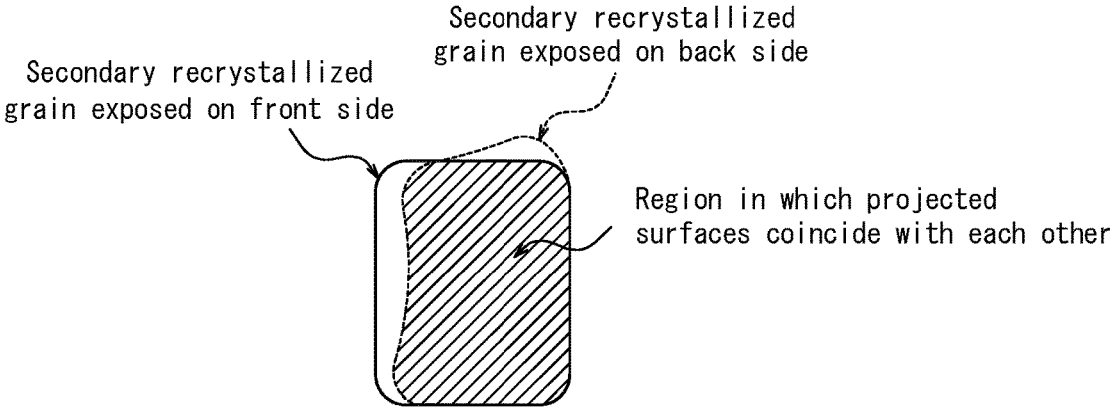
FIG. 2 is a diagram explaining the area ratio of the region in which the projected surfaces coincide with each other.
Figure 3:
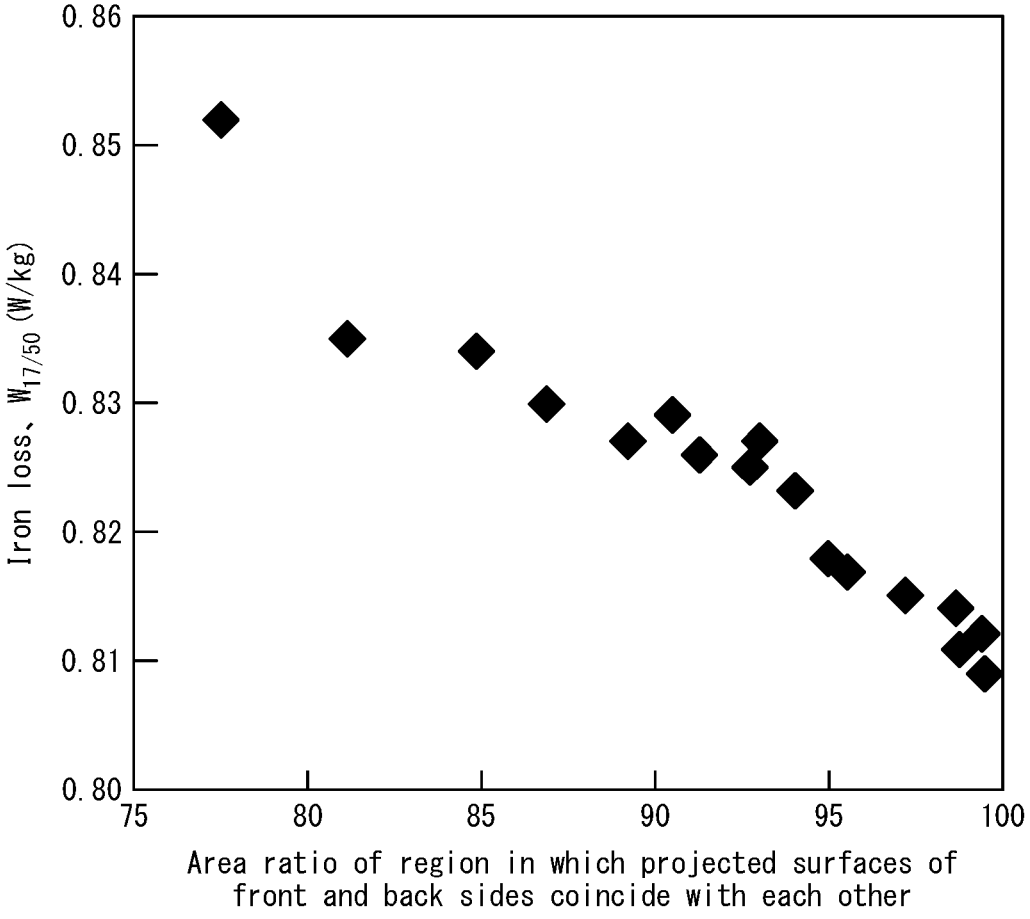
FIG. 3 is a diagram illustrating the relationship between the area ratio of the region in which the projected surfaces coincide with each other and the iron loss of the product steel sheet.

An image of the sample with the exposed secondary recrystallized grains was captured by a scanner with image quality of 300 dpi, the grain boundaries were detected using image analysis software (Photoshop CS6 produced by Adobe Inc.), and an image of only the grain boundaries was generated. This imaging was performed on both the front and back sides of the sample. The image of the front side and the image of the back side were made distinguishable using different colors (e.g. red color on the front side and blue color on the back side), and the two images were superimposed after the image of the back side was mirror-reversed horizontally or vertically. Thus, an orthogonal projection of the grain boundaries on the front side and an orthogonal projection of the grain boundaries on the back side were mapped on one plane parallel to the sheet surface (rolling surface). For every secondary recrystallized grain of 5.0 mm or more in grain size contained in the sample, the region in which the part enclosed by the grain boundary on the front side and the part enclosed by the grain boundary on the back side overlap (coincide) on the same plane as illustrated in FIG. 2 was identified as a "region in which the projected surfaces coincide with each other", and its area ($cm^2$) was calculated. The calculated area was divided by the average value of the area of the part enclosed by the grain boundary on the front side and the area of the part enclosed by the grain boundary on the back side, to calculate the area ratio (%) of the region in which the projected surfaces coincide with each other.

[Grain Size Distribution and Fine Grain Precipitation Frequency]

Based on the image of only the grain boundaries acquired using image analysis software as described above, the area of each grain was calculated, and, the grain size was calculated as an equivalent circle diameter. Thus, the proportions of coarse secondary recrystallized grains of 5.0 mm or more in grain size, fine grains of more than 2.0 mm and less than 5.0 mm in grain size, and very fine grains of 2.0 mm or less in grain size were calculated.

Based on the grain sizes calculated by the foregoing method, the number of fine grains of more than 2.0 mm and less than 5.0 mm in grain size per $cm^2$ was counted.

[Measurement of Misorientation Angle Between Fine Grain Orientation and Goss Orientation]

The sample with the exposed secondary recrystallized grains was sheared to 20 mm square, and the crystal orientation of every fine grain of more than 2.0 mm and less than 5.0 mm in grain size in the obtained 20 mm square sample piece was measured. Here, the crystal orientation was measured from an electron backscatter diffraction image using an electron back-scattering pattern (EBSP) device accompanying a SEM. The average of the misorientation angles between the measured crystal orientations and the Goss orientation was then calculated.

Example 1

Each steel slab containing C: 0.015%, Si: 3.72%, Mn: 0.05%, Al: 0.020%, N: 0.0070%, and Sn: 0.15% with the balance being Fe and inevitable impurities was produced by continuous casting, subjected to slab heating of soaking at 1300° C. for 45 min, and then hot rolled to a thickness of 2.6 mm. The resultant hot-rolled steel sheet was subjected to hot-rolled sheet annealing at 950° C. for 60 sec in a dry nitrogen atmosphere, and then cold rolled to a thickness of 0.23 mm. The resultant cold-rolled steel sheet was heated to 700° C. at the heating rate listed in Table 1 in a dry nitrogen atmosphere, and immediately cooled to room temperature at a cooling rate of 80° C./s on average without soaking. Following this, the steel sheet was subjected to primary recrystallization annealing also serving as decarburization annealing at 850° C. for 90 sec in a wet atmosphere of 60% $H_2$-40% $N_2$ and a dew point of 60° C. Further, an annealing separator mainly composed of MgO was applied to the steel sheet, and the steel sheet was subjected to secondary recrystallization annealing also serving as purification annealing of retaining at the temperature listed in Table 1 for 10 hr in a hydrogen atmosphere.

The iron loss $W_{17/50}$ (iron loss when excited to 1.7 T at 50 Hz) of a sample cut out of each resultant product steel sheet was measured by the method described in HS C 2550-1: 2011. Moreover, the obtained sample was immersed in a 10% hydrochloric acid aqueous solution of 80° C. for 180 sec, and the films on the front and back sides were removed so that secondary recrystallized grains would be recognizable. The grain size distribution of the secondary recrystallized grains was then determined by image analysis. Furthermore, for each coarse secondary recrystallized grain extending through the steel sheet in the thickness direction from among the coarse secondary recrystallized grains of 5 mm or more in grain size, the area ratio of the region in which the projected surfaces of the respective areas of the coarse secondary recrystallized grain exposed on the front and back sides of the steel sheet coincide with each other to each of the areas of the coarse secondary recrystallized grain exposed was calculated for each condition. The area of the sample studied to determine the grain size distribution and the area ratio was 336 $cm^2$ (equivalent to four Epstein samples). The steel substrate composition of the product steel sheet studied using the sample from which the films on the front and back sides had been removed contained, in mass ratio, Si: 3.73%, Mn: 0.05%, and Sn: 0.15%, with the balance being Fe. That is, in the product steel sheet, while C, Al, N, S, and Se were reduced to inevitable impurity levels as a result of decarburization and purification, the contents of the other components were approximately the same as those in the slab.

The results are listed in Table 1. In Table 1, the underlines indicate outside the range according to the present disclosure.

The average misorientation angle between the crystal orientations of the fine grains of more than 2.0 mm and less than 5.0 mm in grain size and the Goss orientation measured for the product steel sheet according to each example was 33.5°.

As is clear from Table 1, favorable iron loss property was achieved with the conditions within the range according to the present disclosure.

TABLE 1

| ID | Heating rate of heating before decarburization annealing (° C./s) | Retention temperature in purification annealing (° C.) | Number of fine grains (/$cm^2$) | Area ratio of coincidence on front and back sides (%) | Iron loss $W_{17/50}$ (W/kg) | Remarks |
|---|---|---|---|---|---|---|
| 1 | 50 | 1200 | 0.08 | 94.1 | 0.876 | Comparative Example |
| 2 | 50 | 1275 | 0.06 | 99.4 | 0.871 | Comparative Example |
| 3 | 150 | 1200 | 0.25 | 93.8 | 0.843 | Comparative Example |
| 4 | 150 | 1275 | 0.24 | 99.3 | 0.817 | Example |
| 5 | 400 | 1200 | 1.35 | 93.5 | 0.835 | Comparative Example |
| 6 | 400 | 1275 | 1.25 | 99.0 | 0.812 | Example |
| 7 | 700 | 1200 | 3.61 | 92.2 | 0.830 | Comparative Example |
| 8 | 700 | 1275 | 3.53 | 98.4 | 0.805 | Example |
| 9 | 1000 | 1200 | 4.23 | 89.9 | 0.826 | Comparative Example |
| 10 | 1000 | 1275 | 4.17 | 95.4 | 0.797 | Example |
| 11 | 2000 | 1200 | 7.97 | 87.5 | 0.911 | Comparative Example |
| 12 | 2000 | 1275 | 7.10 | 94.2 | 0.899 | Comparative Example |

Example 2

Each steel slab containing the components listed in Table 2 with the balance being Fe and inevitable impurities was produced by continuous casting, subjected to slab heating of soaking at 1320° C. for 50 min in the case of containing sol. Al: 150 ppm or more and subjected to slab heating of soaking at 1230° C. for 50 min in the case of containing sol. Al: less than 150 ppm, and then hot rolled to a thickness of 2.0 mm. The resultant hot-rolled steel sheet was subjected to hot-rolled sheet annealing at 1125° C. for 20 sec in a dry nitrogen atmosphere, and then cold rolled to a thickness of 0.20 mm. The resultant cold-rolled steel sheet was heated to 720° C. at a heating rate of 700° C./s in a dry nitrogen atmosphere, and immediately cooled to room temperature at a cooling rate of 120° C./s on average without soaking. Following this, the steel sheet was subjected to decarburization annealing at 830° C. for 140 sec in a wet atmosphere of 45% $H_2$-55% $N_2$ and a dew point of 48° C. Further, an annealing separator mainly composed of MgO was applied to the steel sheet, and the steel sheet was subjected to secondary recrystallization annealing also serving as purification annealing of retaining at 1275° C. for 10 hr in a hydrogen atmosphere. The heating rate in the secondary recrystallization annealing was 20° C./h.

In Table 2, the underlines indicate outside the range according to the present disclosure.

The iron loss $W_{17/50}$ (iron loss when excited to 1.7 T at 50 Hz) and the magnetic flux density $B_8$ (magnetic flux density when excited with a magnetizing force of 800 A/m) of a sample cut out of each resultant product steel sheet were measured by the method described in HS C 2550-1: 2011. Moreover, the obtained sample was immersed in a 10% hydrochloric acid aqueous solution of 80° C. for 180 sec, and the films on the front and back sides were removed so that secondary recrystallized grains would be recognizable. The grain size distribution of the secondary recrystallized grains was then determined by image analysis. Furthermore, for each coarse secondary recrystallized grain extending through the steel sheet in the thickness direction from among the coarse secondary recrystallized grains of 5 mm or more in grain size, the area ratio of the region in which the projected surfaces of the respective areas of the coarse secondary recrystallized grain exposed on the front and back sides of the steel sheet coincide with each other to each of the areas of the coarse secondary recrystallized grain exposed was calculated for each condition. The results are listed in Table 3. The area of the sample studied to determine the grain size distribution and the area ratio was 336 $cm^2$ (equivalent to four Epstein samples).

The steel substrate composition of the product steel sheet studied using the sample from which the films on the front and back sides had been removed is also listed in Table 3. In Table 3, the underlines indicate outside the range according to the present disclosure.

The average misorientation angle between the crystal orientations of the fine grains of more than 2.0 mm and less than 5.0 mm in grain size and the Goss orientation measured for the product steel sheet according to each example was 26.9°.

TABLE 2

| | Slab chemical composition (mass % or mass ppm) | | | | | | | | | | | |
|---|---|---|---|---|---|---|---|---|---|---|---|---|
| ID | C (%) | Si (%) | Mn (%) | N (ppm) | sol•Al (ppm) | S (ppm) | Se (ppm) | Sn (%) | Sb (%) | Mo (%) | P (%) | Others (%, ppm) |
| A | 0.012 | 2.99 | 0.15 | 55 | 270 | 6 | 80 | 0.07 | 0.11 | 0.04 | 0.07 | — |
| B | 0.013 | 3.02 | 0.14 | 47 | 280 | 7 | 70 | 0.015 | — | — | — | — |
| C | 0.015 | 3.01 | 0.15 | 58 | 270 | 7 | 70 | — | 0.018 | — | — | — |
| D | 0.009 | 3.05 | 0.15 | 51 | 290 | 8 | 70 | — | — | 0.018 | — | — |
| E | 0.016 | 3.02 | 0.16 | 53 | 270 | 6 | 80 | — | — | — | 0.011 | — |
| F | 0.025 | 1.33 | 0.17 | 55 | 250 | 8 | 60 | 0.11 | — | — | — | — |
| G | 0.028 | 8.72 | 0.15 | 50 | 270 | 10 | 60 | 0.13 | — | — | — | — |
| H | 0.022 | 3.07 | 0.01 | 49 | 260 | 9 | 50 | 0.18 | — | — | — | — |
| I | 0.024 | 3.11 | 1.11 | 55 | 270 | 8 | 50 | 0.08 | — | — | — | — |
| J | 0.026 | 2.98 | 0.11 | 55 | 280 | 7 | 70 | 0.52 | — | — | — | — |
| K | 0.024 | 3.07 | 0.19 | 56 | 280 | 7 | 70 | — | 0.48 | — | — | — |
| L | 0.025 | 3.05 | 0.18 | 48 | 260 | 6 | 80 | — | — | 0.25 | — | — |
| M | 0.018 | 3.04 | 0.11 | 50 | 270 | 7 | 70 | — | — | — | 0.32 | — |
| N | 0.081 | 3.45 | 0.04 | 78 | 420 | 33 | — | — | 0.035 | 0.02 | — | Cr: 0.06%, Cu: 0.12% |
| O | 0.055 | 2.68 | 0.55 | 24 | 70 | — | 190 | 0.11 | — | — | 0.03 | Cr: 0.02%, Cu: 0.03%, Ni: 0.47%, Nb: 18 ppm |
| P | 0.061 | 3.36 | 0.28 | 11 | 30 | 61 | — | 0.23 | 0.07 | — | 0.18 | Ni: 0.03%, Bi: 0.40%, Nb: 97 ppm |
| Q | 0.037 | 3.07 | 0.15 | 65 | 150 | 17 | 110 | — | 0.07 | 0.06 | — | Cr: 0.44%, Cu: 0.48%, Bi: 0.012% |

TABLE 3

| | Steel substrate composition of product sheet (mass % or mass ppm) | | | | | | | Number of fine | Area ratio of coincidence on front and back | Iron loss | Magnetic flux density | |
|---|---|---|---|---|---|---|---|---|---|---|---|---|
| ID | Si (%) | Mn (%) | Sn (%) | Sb (%) | Mo (%) | P (%) | Others (%, ppm) | grains (/$cm^2$) | sides (%) | $W_{17/50}$ (W/kg) | $B_8$ (T) | Remarks |
| A | 2.99 | 0.15 | 0.07 | 0.11 | 0.04 | 0.07 | — | 3.12 | 98.8 | 0.781 | 1.932 | Example |
| B | 3.02 | 0.14 | 0.015 | — | — | — | — | 3.25 | 99.0 | 0.782 | 1.937 | Example |
| C | 3.01 | 0.15 | — | 0.018 | — | — | — | 3.84 | 99.7 | 0.779 | 1.934 | Example |
| D | 3.05 | 0.15 | — | — | 0.018 | — | — | 3.45 | 96.4 | 0.786 | 1.932 | Example |
| E | 3.02 | 0.16 | — | — | — | 0.011 | — | 3.40 | 98.1 | 0.780 | 1.936 | Example |
| F | 1.33 | 0.17 | 0.11 | — | — | — | — | 2.35 | 98.4 | 1.223 | 1.866 | Comparative Example |
| G | 8.72 | 0.15 | 0.13 | — | — | — | — | | Not secondary recrystallized | | 1.541 | Comparative Example |
| H | 3.07 | 0.01 | 0.18 | — | — | — | — | | Not secondary recrystallized | | 1.562 | Comparative Example |

TABLE 3-continued

| ID | Steel substrate composition of product sheet (mass % or mass ppm) Si (%) | Mn (%) | Sn (%) | Sb (%) | Mo (%) | P (%) | Others (%, ppm) | Number of fine grains (/cm$^2$) | Area ratio of coincidence on front and back sides (%) | Iron loss $W_{17/50}$ (W/kg) | Magnetic flux density $B_8$ (T) | Remarks |
|---|---|---|---|---|---|---|---|---|---|---|---|---|
| I | 3.11 | 1.11 | 0.08 | — | — | — | — | | Not secondary recrystallized | | 1.555 | Comparative Example |
| J | 2.98 | 0.11 | 0.52 | — | — | — | — | 3.32 | 96.2 | 0.955 | 1.884 | Comparative Example |
| K | 3.07 | 0.19 | — | 0.48 | — | — | — | 3.98 | 97.7 | 0.987 | 1.895 | Comparative Example |
| L | 3.05 | 0.18 | — | — | 0.25 | — | — | 4.02 | 97.5 | 1.135 | 1.870 | Comparative Example |
| M | 3.04 | 0.11 | — | — | — | 0.32 | — | | Not secondary recrystallized | | 1.558 | Comparative Example |
| N | 3.45 | 0.04 | — | 0.035 | 0.02 | — | Cr: 0.06%, Cu: 0.12% | 3.55 | 98.3 | 0.759 | 1.940 | Example |
| O | 2.68 | 0.55 | 0.11 | — | — | 0.03 | Cr: 0.02%, Cu: 0.03%, Ni: 0.47%, Nb: 18 ppm | 3.69 | 98.1 | 0.764 | 1.942 | Example |
| P | 3.36 | 0.28 | 0.23 | 0.07 | — | 0.18 | Ni: 0.03%, Bi: 0.40%, Nb: 97 ppm | 3.11 | 97.2 | 0.767 | 1.944 | Example |
| Q | 3.07 | 0.15 | — | 0.07 | 0.06 | — | Cr: 0.44%, Cu: 0.48%, Bi: 0.012% | 3.48 | 99.1 | 0.774 | 1.944 | Example |

As is clear from Table 3, favorable iron loss property was achieved with each chemical composition and steel microstructure within the range according to the present disclosure. In particular, the magnetic flux density of each steel sheet according to the present disclosure was 1.90 T or more.

The invention claimed is:

1. A grain-oriented electrical steel sheet comprising:

a chemical composition containing, in mass %, Si: 1.5% to 8.0%, Mn: 0.02% to 1.0%, and at least one selected from Sn: 0.010% to 0.400%, Sb: 0.010% to 0.400%, Mo: 0.010% to 0.200%, and P: 0.010% to 0.200%, with a balance being Fe and inevitable impurities; and a microstructure in which: crystal grains are made up of coarse secondary recrystallized grains of 5.0 mm or more in grain size, fine grains of more than 2.0 mm and less than 5.0 mm in grain size, and very fine grains of 2.0 mm or less in grain size; for each coarse secondary recrystallized grain extending through the steel sheet in a thickness direction among the coarse secondary recrystallized grains, an area ratio of a region in which projected surfaces of exposed areas of the coarse secondary recrystallized grain on a front side and a back side of the steel sheet coincide with each other to each of the exposed areas is 95% or more; and the fine grains of more than 2.0 mm and less than 5.0 mm in grain size are contained at a frequency of 0.2 grains to 5 grains per cm$^2$, wherein the steel sheet is not magnetic domain refining treated.

2. The grain-oriented electrical steel sheet according to claim 1, wherein an average of misorientation angles between crystal orientations of the fine grains of more than 2.0 mm and less than 5.0 mm in grain size and Goss orientation is 15° or more.

3. The grain-oriented electrical steel sheet according to claim 1, wherein the chemical composition further contains, in mass %, one or more selected from Cr: 0.01% to 0.50%, Cu: 0.01% to 0.50%, Ni: 0.01% to 0.50%, Bi: 0.005% to 0.50%, and Nb: 0.001% to 0.01%.

4. A coil iron core produced using the grain-oriented electrical steel sheet according to claim 1.

5. The grain-oriented electrical steel sheet according to claim 2, wherein the chemical composition further contains, in mass %, one or more selected from Cr: 0.01% to 0.50%, Cu: 0.01% to 0.50%, Ni: 0.01% to 0.50%, Bi: 0.005% to 0.50%, and Nb: 0.001% to 0.01%.

6. A coil iron core produced using the grain-oriented electrical steel sheet according to claim 2.

7. A coil iron core produced using the grain-oriented electrical steel sheet according to claim 3.

8. A coil iron core produced using the grain-oriented electrical steel sheet according to claim 5.

* * * * *